US010612379B2

(12) United States Patent
Lu et al.

(10) Patent No.: US 10,612,379 B2
(45) Date of Patent: Apr. 7, 2020

(54) COMBINED AUTOMATIC ANTI-EXPLOSION METHOD FOR GAS DRAINAGE PIPELINE

(71) Applicants: China University of Mining and Technology, Xuzhou, Jiangsu (CN); XUZHOU JINBO SAFETY AND TECHNOLOGY CO., LTD, Xuzhou, Jiangsu (CN)

(72) Inventors: Caiping Lu, Jiangsu (CN); Heng Zhang, Jiangsu (CN); Yang Liu, Jiangsu (CN); Ding Li, Jiangsu (CN)

(73) Assignees: China University of Mining and Technology, Xuzhou, Jiangsu (CN); XUZHOU JINBO SAFETY AND TECHNOLOGY CO., LTD, Xuzhou, Jiangsu (CN)

( * ) Notice: Subject to any disclaimer, the term of this patent is extended or adjusted under 35 U.S.C. 154(b) by 0 days.

(21) Appl. No.: 16/334,355

(22) PCT Filed: Aug. 3, 2018

(86) PCT No.: PCT/CN2018/098543
§ 371 (c)(1),
(2) Date: Mar. 19, 2019

(87) PCT Pub. No.: WO2019/109654
PCT Pub. Date: Jun. 13, 2019

(65) Prior Publication Data

US 2020/0040726 A1 Feb. 6, 2020

(30) Foreign Application Priority Data

Dec. 7, 2017 (CN) ..... 2017 1 1285818

(51) Int. Cl.
*E21F 7/00* (2006.01)
*E21F 5/14* (2006.01)
(Continued)

(52) U.S. Cl.
CPC ..... *E21F 7/00* (2013.01); *E21F 5/143* (2013.01); *E21F 5/04* (2013.01); *E21F 17/103* (2013.01); *E21F 17/107* (2013.01)

(58) Field of Classification Search
CPC ..... E21F 5/04; E21F 5/14; E21F 5/143; E21F 7/00; E21F 17/103; E21F 17/107
See application file for complete search history.

(56) References Cited

U.S. PATENT DOCUMENTS 3,831,318 A * 8/1974 Richmond ..... E21F 5/14 49/31
3,878,897 A * 4/1975 Goffart ..... A62C 3/02 169/46
(Continued)

FOREIGN PATENT DOCUMENTS

CN 202064990 U 12/2011
CN 103256067 A 8/2013
(Continued)

*Primary Examiner* — Jason L Vaughan
(74) *Attorney, Agent, or Firm* — Winston Hsu

(57) ABSTRACT

The present invention discloses a combined automatic anti-explosion method for a gas drainage pipeline, comprising specific steps of: preparation of an anti-explosion installation piping; connection of the installation piping and the gas drainage pipeline; assembly of a porous foam material and an automatic control valve; installation of an automatic powder-spraying device and a signal analyzer; installation of a temperature sensor and a pressure sensor; and signal processing and automatic anti-explosion. According to the present invention, the porous foam material is located in a bottom groove of an arched pipeline when no gas explosion occurs in the gas drainage pipeline, without affecting the extraction effect of the gas drainage pipeline. If a gas explosion occurs, the present invention blocks the pipeline with the porous foam material due to its fire resistance and pressure reduction performances, and the automatic powder-
(Continued)

spraying device sprays a certain amount of a dry powder explosion suppressant to reduce the explosion overpressure generated in the gas explosion process and isolate the propagation of flame, so that the safety performance of the gas drainage pipeline is ensured, and thus the safety production of coal mines can be ensured.

1 Claim, 2 Drawing Sheets

(51) Int. Cl.
*E21F 5/04* (2006.01)
*E21F 17/103* (2006.01)
*E21F 17/107* (2006.01)

(56) References Cited

U.S. PATENT DOCUMENTS 3,990,464 A * 11/1976 Jenkins ..... A62C 2/06 137/1
4,036,024 A * 7/1977 Dreker ..... E21F 17/107 405/132
4,056,939 A * 11/1977 Alvarez-Calderon ..... E21C 41/16 405/267
5,234,374 A * 8/1993 Hyzyk ..... F24F 11/89 454/322
5,469,920 A * 11/1995 Conti ..... A62C 3/02 169/48
5,501,284 A * 3/1996 Clodfelter ..... A62C 99/0018 169/54
5,558,131 A * 9/1996 Cohee ..... F16L 55/128 137/225
6,012,532 A * 1/2000 Kiefer ..... A62C 3/02 169/26
10,252,092 B2 * 4/2019 Mataradze ..... A62C 37/36
2011/0272402 A1 * 11/2011 Lamond ..... E21F 15/02 220/86.1
2014/0056646 A1 2/2014 Aulisio

FOREIGN PATENT DOCUMENTS

CN 105804782 A 7/2016
CN 108019235 A 5/2018
RU 2038482 C1 6/1995

* cited by examiner

COMBINED AUTOMATIC ANTI-EXPLOSION METHOD FOR GAS DRAINAGE PIPELINE

BACKGROUND OF THE INVENTION

1. Field of the Invention

The present invention relates to an automatic anti-explosion method, and in particular, to a combined automatic anti-explosion method for a gas drainage pipeline.

2. Description of the Prior Art

In recent years, with the massive consumption of coal energy, coal mining has gradually developed into deep mining, and that is accompanied by a gradual increase in surrounding rock stress, so that a large amount of gas is accumulated. High concentrations of gas have a very negative impact on underground coal production. Gas extraction is a basic method for coal gas control, and it is also a basic means of gas utilization. Gas extraction technology is attracting more and more attention from all over the world. At present, the piping for gas extraction and utilization systems used in China can be summarized as two types, i.e., automatic fire extinguishing and anti-explosion devices and mechanical anti-explosion devices. The automatic fire extinguishing and anti-explosion device is advanced in technology, high in sensitivity and good in reliability, and has the advantage of applying a small sensor to a pipeline with almost no resistance, which is beneficial to gas drainage, but also has the shortcomings of complicated technology, high cost, and large space occupation. Although the automatic fire extinguishing and anti-explosion device has a special effect on the fire resistance and temperature reduction in the explosion suppression process, it has little effect on the reduction of the explosion overpressure in the flame propagation. The mechanical anti-explosion device has the advantages of simple structure, low cost, convenient maintenance, safety and reliability. However, for a dry-type anti-explosion device, the passing rate of a fire barrier is small, resulting in a large resistance of the piping system, and thus affecting the gas extraction effect. For a wet-type anti-explosion device, since gas is discharged after passing through a water bath, water in a water tank is easily pumped away under the action of a negative pressure, and the water tank should be replenished continuously, otherwise the anti-explosion effect will be lost. Due to the high gas concentration and high risk in the gas drainage pipeline, it is necessary to improve the safety performance in the gas drainage pipeline.

SUMMARY OF THE INVENTION

Technical Problem

In view of the foregoing problems in the prior art, the present invention provides a combined automatic anti-explosion method for a gas drainage pipeline, which does not affect the gas drainage effect if no gas explosion occurs, and once a gas explosion occurs, it can reduce the explosion overpressure generated in the gas explosion effectively and block the propagation of flame to ensure the safety production of coal mines.

Technical Solution

To achieve the foregoing objective, the present invention adopts the following technical solution: a combined automatic anti-explosion method for a gas drainage pipeline, comprising specific steps of:

A. Preparation of an anti-explosion installation piping: a circular pipeline with interfaces at both ends having the same pipe diameter r as the gas drainage pipeline is prepared, and then two arched pipelines are respectively arranged in the piping at 30 cm from the interfaces at both ends, the arc radius of the arched pipeline is the same as the pipe diameter r of the circular pipeline, and the waist height of the arched pipeline is the sum of the pipe diameter r of the circular pipeline and the thickness H of a porous foam material;

B. Connection of the installation piping and the gas drainage pipeline: in the installation process of the gas drainage pipeline, the anti-explosion installation piping is connected to the gas drainage pipeline and that is sealed by a seal ring coated with petrolatum to prevent air leakage;

C. Assembly of a porous foam material and an automatic control valve: screws on the anti-explosion installation piping are unscrewed, and a prefabricated porous foam material is installed in the arched pipeline of the anti-explosion installation piping; meanwhile, an automatic control valve is installed at one side of the arched pipeline, and a rotary device in the automatic control valve is extended into the arched pipeline and is welded to the porous foam material to ensure that the rotary device can erect the porous foam material;

D. Installation of an automatic powder-spraying device and a signal analyzer: a nozzle of the automatic powder-spraying device is a screw rod having a smooth interior and a spiral exterior, the anti-explosion installation piping is provided with a matching threaded port, the automatic powder-spraying device is screwed on the anti-explosion installation piping, and the nozzle is slightly higher than an inner wall of the anti-explosion installation piping, so as to prevent water in the piping from entering the nozzle; and moreover, the nozzle is sealed by a plastic wrap to prevent the automatic powder-spraying device from moisture and a dry powder explosion suppressant from deteriorating; the automatic powder-spraying device and the signal analyzer are connected through a data line, and the signal analyzer and the automatic control valve are connected through a data line;

E. Installation of a temperature sensor and a pressure sensor: a set of temperature sensors and pressure sensors are respectively installed 20 m in the front and rear of the gas drainage pipeline, and the temperature sensor and the pressure sensor are respectively connected to the signal analyzer through a data line, to ensure the accuracy of signal analysis of the signal analyzer; and F: Signal processing and automatic anti-explosion: in the gas drainage process, if the temperature or pressure in the gas drainage pipeline changes, the temperature sensor or the pressure sensor detects an abnormal signal and transmits the same to the signal analyzer; if the temperature in the pipeline is above 1.5 times of the maximum temperature in normal operation or the pressure is above 3 times of the maximum pressure in normal operation, it can be determined as gas explosion after the analysis of the signal analyzer, a signal is sent to control the automatic control valve and the automatic powder-spraying device to be turned on, and a limit pin in the automatic control valve is automatically opened; the rotary device erects the porous foam material at two sides under the action of the rotary force to seal the pipeline, and, the automatic powder-spraying device sprays a certain amount of the dry powder explosion suppressant, such that the porous foam material and the dry powder explosion suppressant together suppress explosion, to complete the whole anti-explosion process.

Advantageous Effect

Compared with the prior art, the present invention adopts a new anti-explosion mode, and a porous foam material is located in a bottom groove of an arched pipeline when no gas explosion occurs in a gas drainage pipeline, without affecting the extraction effect of the gas drainage pipeline. If a gas explosion occurs, the present invention blocks the pipeline with the porous foam material due to its fire resistance and pressure reduction performances, and an automatic powder-spraying device sprays a certain amount of a dry powder explosion suppressant to reduce the explosion overpressure generated in the gas explosion process and isolate the propagation of flame, and a local anti-explosion space can be formed in the gas drainage pipeline, and moreover, the concentration of the sprayed dry powder explosion suppressant can be prevented from being reduced due to the precursor shock wave generated by the explosion to reduce its anti-explosion effect, so that the safety performance of the gas drainage pipeline is ensured, and thus the safety production of coal mines can be ensured.

These and other objectives of the present invention will no doubt become obvious to those of ordinary skill in the art after reading the following detailed description of the preferred embodiment that is illustrated in the various figures and drawings.

Figure 1:
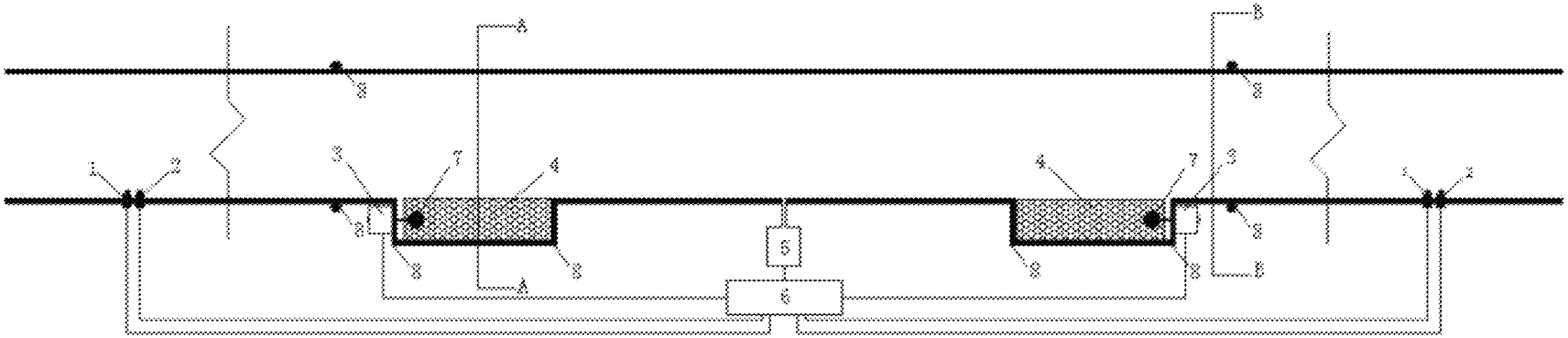
FIG. 1 is a schematic structural diagram of the present invention.

In the drawings: 1 temperature sensor; 2 pressure sensor; 3 automatic control valve; 4 porous foam material; 5 automatic powder-spraying device; 6 signal analyzer; 7 rotary device; 8 screw.

DETAILED DESCRIPTION

The present invention is further described below.

Figure 2:
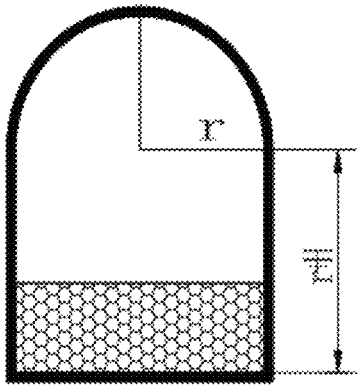
FIG. 2 is a schematic cross-sectional view along line A-A of FIG. 1.
Figure 3:
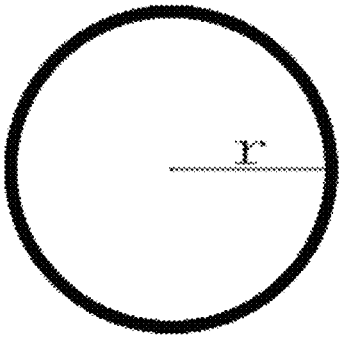
FIG. 3 is a schematic cross-sectional view along line B-B of FIG. 1.
Figure 4:
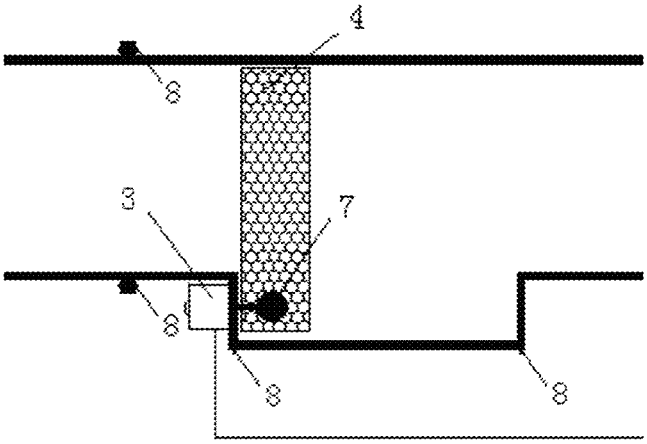
FIG. 4 is a schematic location diagram of a porous foam material of the present invention during anti-explosion.

As shown in FIGS. 1-4, specific steps of the present invention are:

A. Preparation of an anti-explosion installation piping: a circular pipeline with interfaces at both ends having the same pipe diameter r as a gas drainage pipeline is prepared, and then two arched pipelines are respectively arranged in the piping at 30 cm from the interfaces at both ends, the arc radius of the arched pipeline is the same as the pipe diameter r of the circular pipeline, and the waist height of the arched pipeline is the sum of the pipe diameter r of the circular pipeline and the thickness H of a porous foam material;

B. Connection of the installation piping and the gas drainage pipeline: in the installation process of the gas drainage pipeline, the anti-explosion installation piping is connected to the gas drainage pipeline and that is sealed by a seal ring coated with petrolatum to prevent air leakage;

C. Assembly of a porous foam material and an automatic control valve: screws 8 on the anti-explosion installation piping are unscrewed, and a prefabricated porous foam material 4 is installed in the arched pipeline of the anti-explosion installation piping; meanwhile, an automatic control valve 3 is installed at one side of the arched pipeline, and a rotary device 7 in the automatic control valve 3 is extended into the arched pipeline and is welded to the porous foam material 4 to ensure that the rotary device 7 can erect the porous foam material 4;

D. Installation of an automatic powder-spraying device 5 and a signal analyzer 6: a nozzle of the automatic powder-spraying device 5 is a screw rod having a smooth interior and a spiral exterior, the anti-explosion installation piping is provided with a matching threaded port, the automatic powder-spraying device 5 is screwed on the anti-explosion installation piping, and the nozzle is slightly higher than an inner wall of the anti-explosion installation piping, so as to prevent water in the piping from entering the nozzle; and moreover, the nozzle is sealed by a plastic wrap to prevent the automatic powder-spraying device 5 from moisture and a dry powder explosion suppressant from deteriorating; the automatic powder-spraying device 5 and the signal analyzer 6 are connected through a data line, and the signal analyzer 6 and the automatic control valve 3 are connected through a data line;

E. Installation of a temperature sensor 1 and a pressure sensor 2: a set of temperature sensors 1 and pressure sensors 2 are respectively installed 20 m in the front and rear of the gas drainage pipeline, and the temperature sensor 1 and the pressure sensor 2 are respectively connected to the signal analyzer 6 through a data line, to ensure the accuracy of signal analysis of the signal analyzer 6; and F: Signal processing and automatic anti-explosion: in the gas drainage process, if the temperature or pressure in the gas drainage pipeline changes, the temperature sensor 1 or the pressure sensor 2 detects an abnormal signal and transmits the same to the signal analyzer 6; if the temperature in the pipeline is above 1.5 times of the maximum temperature in normal operation or the pressure is above 3 times of the maximum pressure in normal operation, it can be determined as gas explosion after the analysis of the signal analyzer 6, a signal is sent to control the automatic control valve 3 and the automatic powder-spraying device 5 to be turned on, and a limit pin in the automatic control valve 3 is automatically opened; the rotary device 7 erects the porous foam material 4 at two sides under the action of the rotary force to seal the pipeline, and, the automatic powder-spraying device 5 sprays a certain amount of the dry powder explosion suppressant, such that the porous foam material 4 and the dry powder explosion suppressant together suppress explosion, to complete the whole anti-explosion process.

The porous foam material 4, the automatic control valve 3, the rotary device 7, the automatic powder-spraying device 5, the signal analyzer 6, the temperature sensor 1, and the pressure sensor 2 are existing products.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A combined automatic anti-explosion method for a gas drainage pipeline, the method comprising:

providing a circular pipeline with interfaces at both ends having a pipe diameter r that is the same diameter as that of the gas drainage pipeline;

arranging two arched pipelines in the circular pipeline at 30 cm from the interfaces at both ends in order to form an anti-explosion installation piping, wherein an arc radius of the arched pipeline is the same as the pipe diameter r of the circular pipeline, and a waist height of the arched pipeline is the sum of the pipe diameter r of the circular pipeline and a thickness H of a porous foam material;

connecting the anti-explosion installation piping to the gas drainage pipeline and sealing the connection between the anti-explosion installation piping and the gas drainage pipeline using a seal ring coated with petrolatum, wherein the anti-explosion installation piping includes screws;

unscrewing the screws and installing the porous foam material in the arched pipeline of the anti-explosion installation piping;

installing an automatic control valve at one side of the arched pipeline;

extending a rotary device of the automatic control valve into the arched pipeline and welding the rotary device to the porous foam material such that the rotary device is capable of erecting the porous foam material;

providing an automatic powder-spraying device and a signal analyzer, wherein a nozzle of the automatic powder-spraying device is a screw rod having a smooth interior and a spiral exterior, wherein the anti-explosion installation piping is provided with a matching threaded port;

threading the automatic powder-spraying device into the threaded port of the anti-explosion installation piping, and locating the nozzle apart from an inner wall of the anti-explosion installation piping;

sealing the nozzle with a plastic wrap;

connecting the automatic powder-spraying device and the signal analyzer through a first data line;

connecting the signal analyzer and the automatic control valve through a second data line;

installing a temperature sensor and a pressure sensor at 20 m within each end of the gas drainage pipeline;

connecting the temperature sensor and the pressure sensor to the signal analyzer through a third data line; and during a drainage process using the gas drainage pipeline, monitoring temperature and pressure within the gas drainage pipeline utilizing the temperature sensor and the pressure sensor; and erecting the porous foam material using the rotary device and spraying dry powder explosion suppressant using the automatic powder-spraying device, wherein the erecting and spraying occurs only when the temperature detected by the temperature sensor is more than 1.5 times greater than a maximum normal operating temperature of the gas drainage pipeline or when the pressure detected by the pressure sensor is more than 3 times greater than a maximum normal operating pressure of the gas drainage pipeline.

* * * * *